United States Patent [19]

Radmore et al.

[11] Patent Number: 4,537,368

[45] Date of Patent: Aug. 27, 1985

[54] PENDULUM ROLL LOADER

[75] Inventors: Robert R. Radmore, Olcott; John T. Hall, Williamsville, both of N.Y.

[73] Assignee: Carborundum Abrasives Company, Niagara Falls, N.Y.

[21] Appl. No.: 605,789

[22] Filed: May 1, 1984

[51] Int. Cl.[3] ..... B65H 19/30

[52] U.S. Cl. ..... 242/58.6

[58] Field of Search ..... 242/58.6, 79, 58.2, 242/58.3, 64; 414/589, 590, 592, 911, 113

[56] References Cited

U.S. PATENT DOCUMENTS

| | | | |
|---|---|---|---|
| 2,590,865 | 4/1952 | Johnson | 242/58.6 X |
| 3,219,206 | 11/1965 | Cocker | 242/58.6 X |
| 3,351,299 | 11/1967 | Fehr | 242/79 |
| 3,462,094 | 8/1969 | Shumaker | 242/79 |
| 3,695,539 | 10/1972 | Lindstaedt | 242/58.6 |
| 3,889,831 | 6/1975 | Davis | 242/58.6 X |
| 3,987,911 | 10/1976 | Euverand et al. | 414/113 |
| 4,131,206 | 12/1978 | Kawada et al. | 242/58.6 X |

*Primary Examiner*—Stephen Marcus
*Assistant Examiner*—Leo J. Peters
*Attorney, Agent, or Firm*—Michael L. Dunn; William H. Holt

[57] ABSTRACT

Apparatus for sequentially presenting a series of rolls of cloth or paper, etc. to an unwind device, the rolls being precisely positioned for automatically being grasped by chuck members on the unwinder. Storage and transfer means are provided for assuring a constant supply of rolls being presented.

4 Claims, 7 Drawing Figures

PENDULUM ROLL LOADER

BRIEF SUMMARY OF THE INVENTION

The invention relates to apparatus for handling rolls of material, the apparatus including storage means for storing a plurality of rolls of material, an unwinder device including means for receiving a shaft of one of the rolls and supporting the shaft during unwinding of the material thereon, and a transfer means for sequentially indexing each of the plurality of rolls of material from the storage means to the unwinder device.

The invention further relates to apparatus for storing a roll of material and presenting the roll to a work station, the apparatus including a roll supporting platform for receiving and supporting the roll of material, means for temporarily retaining a roll of material on the roll supporting platform, and means for moving the roll of material from the supporting platform toward a work station.

Still further, the invention relates to apparatus for precisely positioning a roll of material without regard for the weight or diameter of the roll, the apparatus comprising lift means for raising the roll of material, and cam means for positioning the roll axially of itself during lifting of the roll by the lift means.

DETAILED DESCRIPTION OF THE INVENTION

Figure 1:
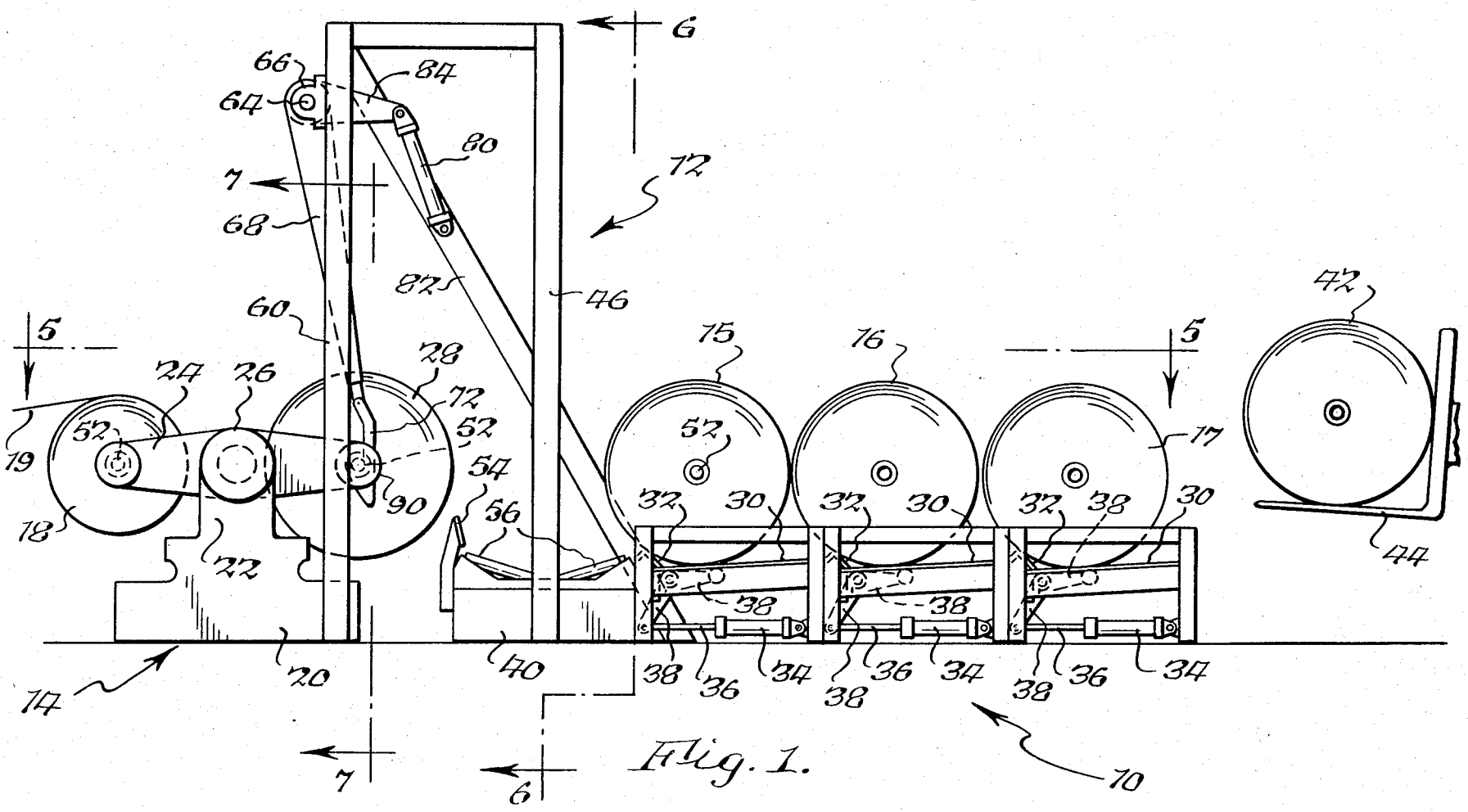
FIG. 1 is a side elevation view of the invention and illustrates that rolls of material are placed upon a first support platform or table by a fork-lift truck, or otherwise, and each roll is then moved one at a time, from right to left, onto an elevator or lift table, subsequently raised into position to by grasped by pendulum hooks and delivered to an unwinder device, connected thereto by spaced chucks and then swung into a delivery or unwind position.

As is best shown in FIG. 1, the invention is comprised of essentially three main components including a storage section generally indicated by the numeral 10, roll transfer apparatus generally indicated by the numeral 12, and an unwinder device generally indicated by the numeral 14. A series of rolls of material 15, 16 and 17 are retained in storage section 10 ready for use in a manner which will be later described.

It will be seen at the left of FIG. 1 that a roll of material 18 is being depleted by having a web of material 19 being unwound therefrom. The web 19 may be fed to any of a number of different machines for any series of operations thereon which do not form part of the present invention. However, for illustrative purposes, one can imagine the web 19 as being fed to a coating machine, or a printing machine or a cutting machine, or any other type of similar devices.

The unwinder device 14 is a known piece of equipment and includes a base 20, upstanding support pedestals 22 and support arms 24 rotatably mounted in a pillow box 26 and is usually driven by a motor (not shown) for rotating the support arms 24 of roll 18 in order to place the next roll of material 28 in the operative unwinding position.

Following the complete unwinding of the roll of material 18 and the subsequent rotation of support arms 24 to position roll of material 28 in the unwinding position, the invention contemplates the sequential feeding of the rolls of material 15, 16 and 17 from the storage section 10 to the unwinder device 14 by the transfer apparatus 12.

Figure 2:
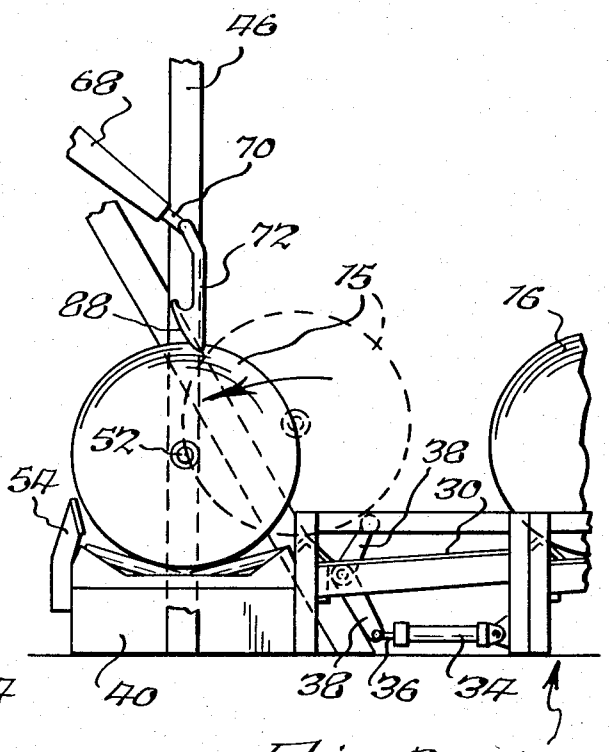
FIG. 2 is a fragmentary view, similar to FIG. 1, illustrating a roll of material being moved onto the lift table.

Storage section 10 is comprised of a series of identical support platforms 30 each of which is slightly inclined for causing the rolls of material to rest against a bumper or stop member 32. Each supporting platform 30 is provided with a fluid motor, preferably in the form of a hydraulic cylinder 34 and a piston rod 36 which is pivotally connected to a push lever 38 which, in turn, is pivotally mounted beneath the supporting platform 30 such that, as is best shown in FIG. 2, upon retraction of the piston rod 36 into the cylinder 34, the push lever 38 rotates upwardly and displaces the roll of material 15 off of the supporting platform 30 and onto a lift table 40 for a purpose to be later described. At this point of the operation, it is to be understood that, following the positioning of roll 15 upon the lift table 40, the rolls of material 16 and 17 are, sequentially, stepped forward to the left in FIG. 1 and an additional roll of material 42 is placed upon the first supporting platform 30 through the use of a fork-lift truck 44 or any other type of roll handling apparatus.

Figure 5:
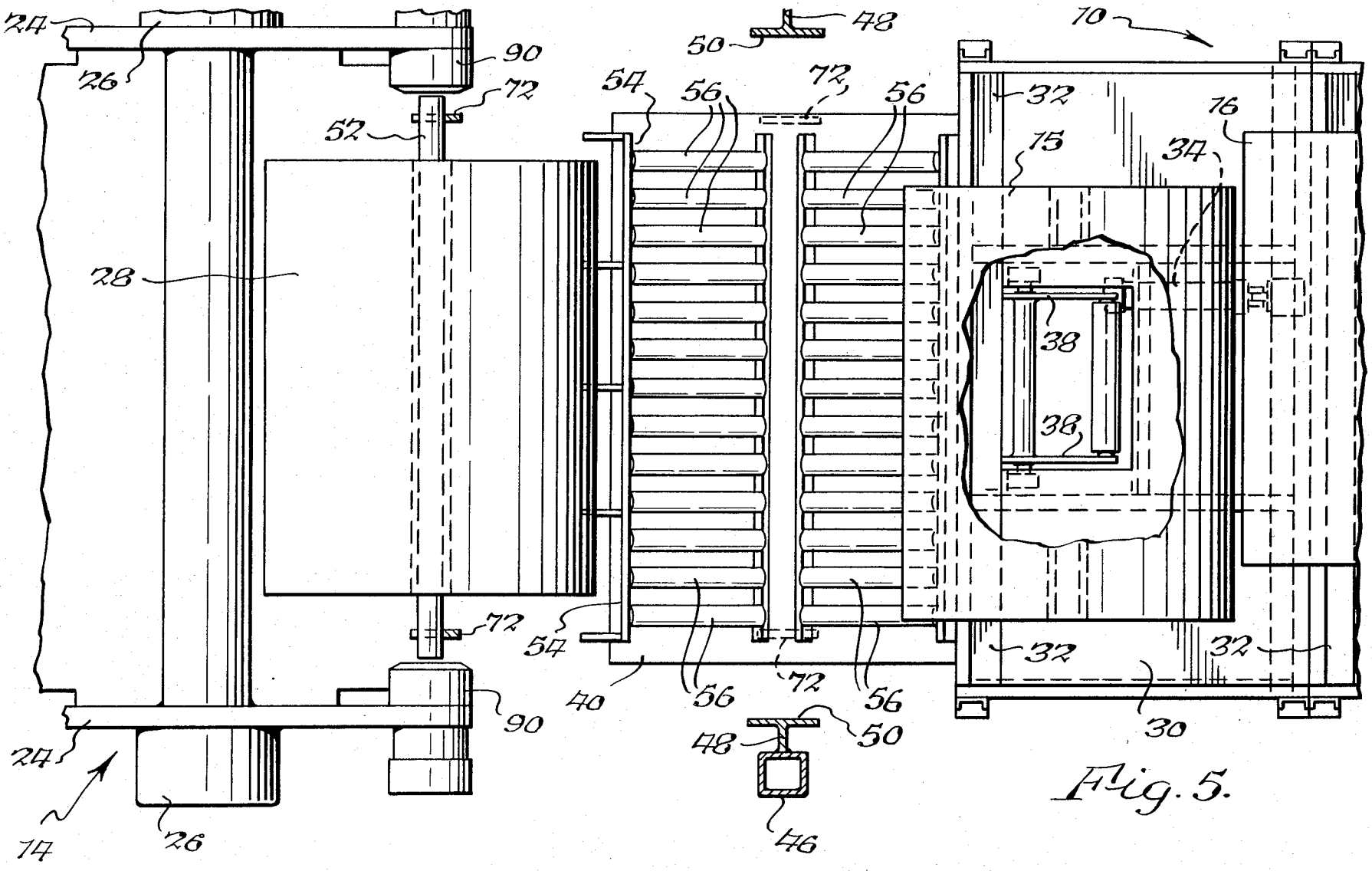
FIG. 5 is a fragmentary plan view taken along line 5—5 in FIG. 1.
Figure 6:
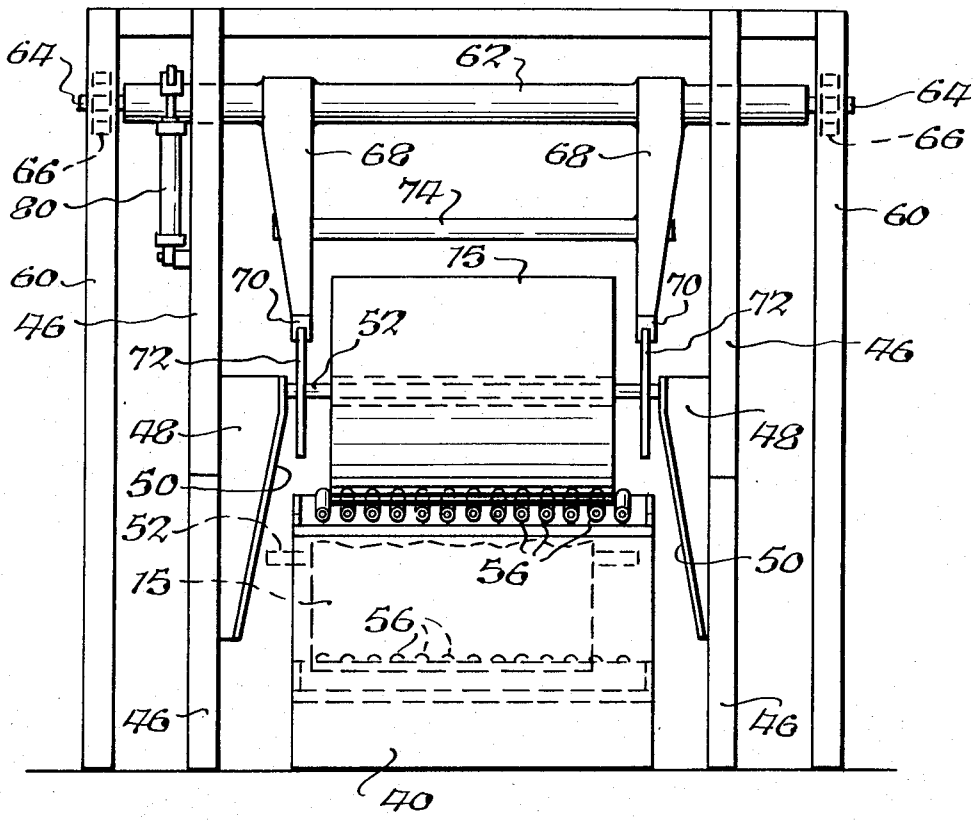
FIG. 6 is a vertical sectional view taken along line 6—6 in FIG. 1 and illustrates a pair of spaced cams which, automatically centers the roll of material through interaction of the cams with the roll shaft.

Referring particularly to FIGS. 1 and 6, transfer apparatus 12 includes a pair of support posts 46 disposed alongside opposite ends of lift table 40, each post 46 having fixedly secured along its vertical inside surface a support web 48 and an inwardly and upwardly tapered cam surface 50. The cam surfaces 50 function by engaging the end, or ends, of a roll shaft 52, which roll shaft 52 is fixedly secured quite precisely centrally in roll of material 15. It is believed to be readily understandable that when the various rolls of material 15, 16, 17, etc. are each placed in the storage section 10 by the fork-lift 44, the respective rolls can be, and most likely are, offset laterally with respect to each other and are, therefore, not in the necessary precise transverse alignment for being properly received within the support arms 24 of the unwinder device 14. Referring to FIGS. 2, 3, 5 and 6, retraction of piston rod 36 into cylinder 34 causes rotation of lever 38 upwardly through a central opening in supporting platform 30 (see FIG. 5) such that roll 15 is forced over the bumper or stop member 32 and roll 15 comes to rest upon lift table 40. A bumper or stop member 54 is secured to lift table 40 to prevent roll 15 from moving too far. Lift table 40 includes a plurality of angularly disposed anti-friction rollers 56 which support the roll of material thereon and provide for freedom of movement of the roll 15 in a direction along its axis such that, as is best shown in FIG. 6, upon raising of the lift table 40 the roll shaft 52 (shown in broken lines near the bottom of FIG. 6 and misaligned to the left of center) is, during raising of the lift table 40, brought into engagement with the left-most cam surface 50 causing the roll of material 15 to be moved to the right on anti-friction rollers 56 such that the material is precisely positioned not only with regard to vertical height but also in the lateral or transverse direction. It is at this stage of the operation that the roll shaft 52 is for the first time located in a predetermined, precise position.

Transfer apparatus 12 includes a second pair of vertically disposed support posts 60 which are located on opposite sides of unwinder device 14. A support tube 62 extends between the support posts 60 and is pivotally mounted thereon by spaced trunnions 64 which are rotatably mounted within pillow blocks 66. A pair of spaced pendulum lift arms 68 are rigidly secured to the support tube 62 and each lift arm 68 is provided at its lowermost end with a clevis 70 and spaced lift hooks 72 pivotally mounted within each clevis 70. A brace member 74, as best shown in FIG. 6, is securely fastened between the respective arms 68 to provide additional strength.

Figure 3:
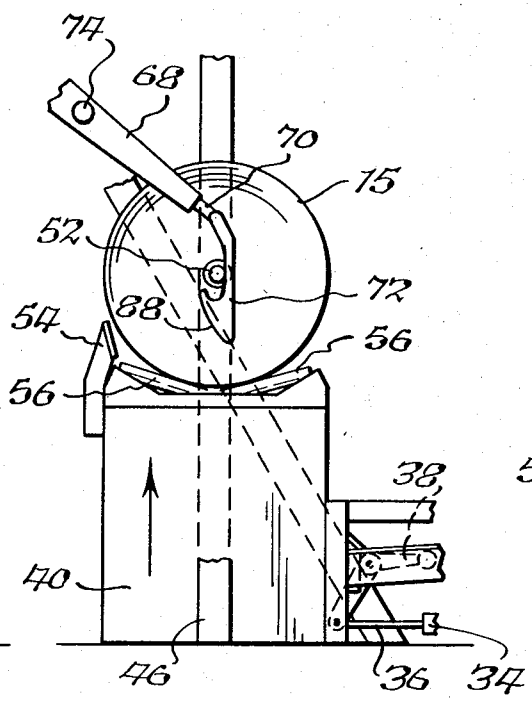
FIG. 3 is a fragmentary view, similar to FIG. 2 and illustrates the lift table being in a raised position and the lift hooks being automatically positioned beneath the roll shaft.
Figure 4:
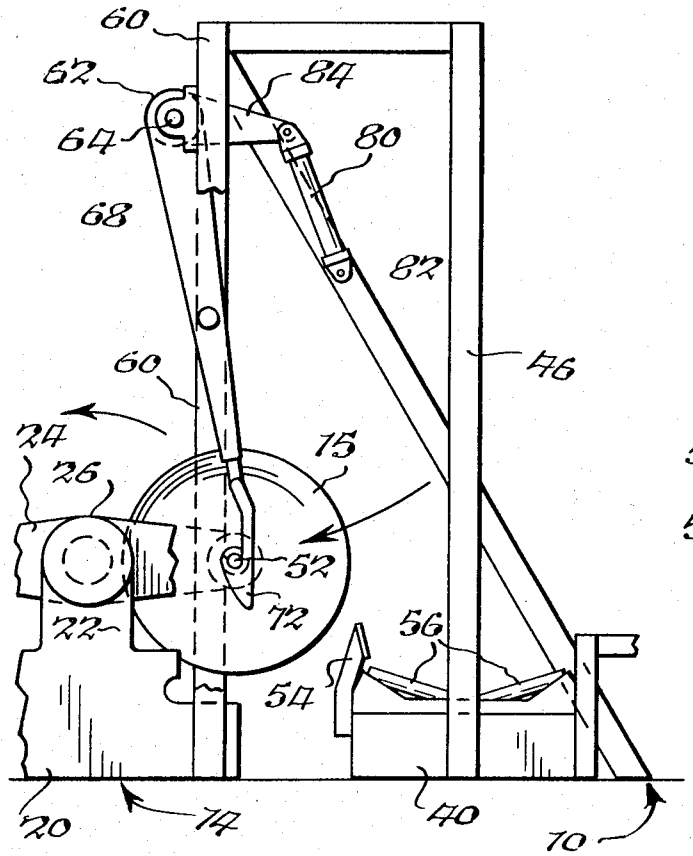
FIG. 4 is a fragmentary view and illustrates a roll of material being placed in the unwinder device following retraction of the lift table.
Figure 7:
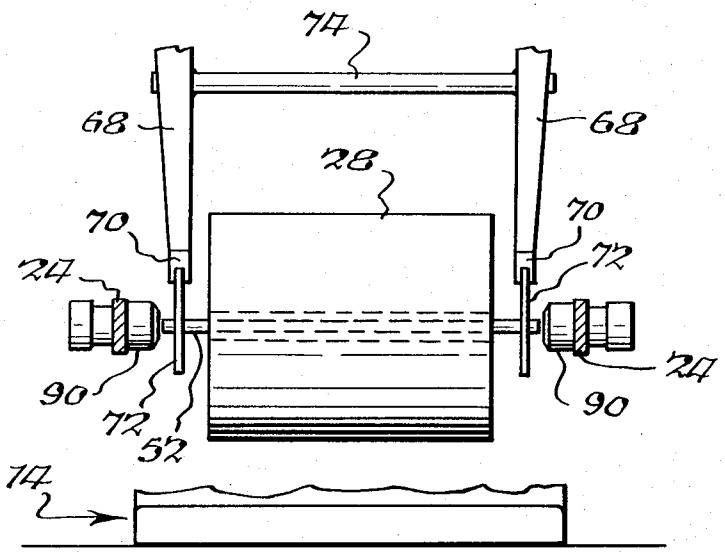
FIG. 7 is a fragmentary sectional view taken along line 7—7 in FIG. 1 and illustrates the lift hooks holding the roll of material in an accurately aligned position ready to be grasped by spaced chucks of the unwinder device.

Referring particularly to FIGS. 2, 3 and 4, the lift hooks 72 are rotatable with support tube 62 by an extensible fluid motor 80 which is pivotally connected between a support brace 82 and a crank 84, the crank 84 being fixedly secured to the support tube 62. Preferably, the fluid motor 80 is a conventional hydraulic cylinder and piston rod such that, upon extension of the piston rod, the support arms 68 are moved on trunnions 64 to bring the lift hooks 72 into the position shown in FIG. 2 in spaced relation above the roll shaft 52 contained in the roll of material 15. In operation, after the roll 15 is moved onto the lift table 40, as is shown in FIG. 2, the lift table 40 is moved upwardly as is shown in FIG. 3. During this upward movement, the roll shaft 52 will strike a cam surface 88 on the underside of the hooks 72 for temporarily swinging the hooks 72 from the path of the roll shaft 52, the hooks 72 then rotating on clevis 70 into the position shown in FIG. 3. During this lifting motion, as will be best understood by referring to FIG. 6, a misaligned roll 15 and roll shaft 52 will engage one or the other of cam surfaces 50 for causing the roll 15 to be moved upon anti-friction rollers 56 into precise alignment for being accurately received by the unwinder device 14. As the piston rod is retracted into fluid motor 80, as is shown in FIG. 4, the roll of material 15 is carried from above the now collapsed lift table 40 and swung into precise alignment with the unwinder device 14 to be grasped by a pair of spaced chuck members 90 which are carried by the support arms 24 of the unwinder device 14, as shown in FIGS. 5 and 7.

From the foregoing description of the preferred embodiment, it is apparent that the invention contemplates the sequential positioning of rolls of material to an unwinder device in such a manner that the rolls are moved from a storage section by means of transfer apparatus which automatically align the roll shafts during the transfer operation. While a preferred embodiment of the invention has been shown and described in detail, the invention is not limited to such a preferred apparatus but is to be limited only by the spirit and scope of the invention as defined by the claimed subject matter.

We claim:

1. Apparatus for handling rolls of material, said apparatus including storage means for storing a plurality of rolls of material, an unwinder device including means for receiving a shaft of one of said rolls and supporting said shaft during unwinding of the material thereon, transfer means for sequentially indexing each of said plurality of rolls of material from said storage means to said unwinder device, said transfer means including lift means for raising one of said rolls of material, cam means for axially positioning said roll into alignment with said means for receiving a shaft during lifting of said roll by said lift means, said lift means including anti-friction means for supporting said roll of material and providing freedom of movement axially of said roll, a roll shaft carried by said roll of material and engageable with said cam means during lifting of said roll for moving said roll in a direction axially of said shaft on said anti-friction means, said transfer means including a frame, hook means pivotally mounted on said frame and engageable with said roll shaft for supporting said roll of material following precise positioning of said roll shaft by said cam means.

2. Apparatus as defined in claim 1 wherein said unwinder device includes spaced members for receiving said roll shaft and supporting a roll of material thereon, and means on said frame for moving said roll of material from said lift means and bringing said roll shaft into alignment with said spaced members of said unwinder device.

3. Apparatus for precisely positioning a roll of material without regard for the weight or diameter of said roll, a shaft secured in said roll axially thereof, said apparatus comprising lift means for raising said roll of material, cam means for engaging an end of said shaft and moving said roll axially during lifting of said roll by said lift means, said lift means including anti-friction means for supporting said roll of material and providing freedom of movement axially of said roll, a frame located adjacent to said lift means, transfer means carried by said frame, hook means pivotally mounted on said transfer means and engageable with said shaft for supporting said roll of material, said hook means including a cam surface engageable with said shaft during said movement of said roll for moving said hook from the path of movement of said shaft.

4. Apparatus for precisely positioning a roll of material without regard for the weight or diameter of said roll, a shaft secured in said roll axially thereof, said apparatus comprising lift means for raising said roll of material, cam means for engaging an end of said shaft and moving said roll axially during lifting of said roll by said lift means, said lift means including anti-friction rollers for engaging and supporting said roll of material and providing freedom of movement axially of said roll, a frame located adjacent to said lift means, transfer means carried by said frame, means carried by said transfer means for providing a connection with said shaft and means for moving said transfer means and said roll of material from a first position to a second position.

* * * * *